US008250889B2

(12) United States Patent
Zagoroff

(10) Patent No.: US 8,250,889 B2
(45) Date of Patent: Aug. 28, 2012

(54) COMPACT POWER LOCK

(75) Inventor: Dimiter S. Zagoroff, Lincoln, MA (US)

(73) Assignee: Pop & Lock, LLC, Green Bay, WI (US)

( * ) Notice: Subject to any disclaimer, the term of this patent is extended or adjusted under 35 U.S.C. 154(b) by 255 days.

(21) Appl. No.: 12/583,963

(22) Filed: Aug. 27, 2009

(65) Prior Publication Data

US 2010/0050714 A1 Mar. 4, 2010

Related U.S. Application Data

(60) Provisional application No. 61/092,303, filed on Aug. 27, 2008.

(51) Int. Cl.
*E05B 47/00* (2006.01)

(52) U.S. Cl. ..... 70/279.1; 70/208; 70/237; 292/336.3; 292/201; 292/144; 292/DIG. 23; 292/DIG. 43

(58) Field of Classification Search ..... 70/208, 70/237, 264, 279.1; 292/336.3, 144, 201, 292/216, DIG. 23, DIG. 29, DIG. 42, DIG. 43
See application file for complete search history.

(56) References Cited

U.S. PATENT DOCUMENTS 2,793,907 A * 5/1957 Hess et al. ..... 296/106
5,174,619 A * 12/1992 Bender et al. ..... 292/336.3
5,295,374 A * 3/1994 Bender et al. ..... 70/208
5,411,302 A * 5/1995 Shimada ..... 292/201
5,448,856 A * 9/1995 Moore et al. ..... 49/340
5,642,636 A * 7/1997 Mitsui ..... 70/237
5,764,010 A * 6/1998 Maue et al. ..... 318/443
5,829,799 A * 11/1998 Yamagishi et al. ..... 292/201
5,852,943 A * 12/1998 Dutka et al. ..... 70/237
6,065,316 A * 5/2000 Sato et al. ..... 70/264
6,098,432 A * 8/2000 Spies ..... 70/237
6,192,725 B1 * 2/2001 Watson et al. ..... 70/208
6,343,494 B2 * 2/2002 Roos et al. ..... 70/264
6,386,599 B1 * 5/2002 Chevalier ..... 292/201
6,490,896 B2 * 12/2002 Segawa ..... 70/208
6,523,869 B1 * 2/2003 Jensen et al. ..... 292/336.3
6,843,085 B2 * 1/2005 Dimig ..... 70/237
6,923,481 B2 * 8/2005 Bruderick et al. ..... 292/336.3
2004/0195845 A1 * 10/2004 Chevalier ..... 292/201

* cited by examiner

*Primary Examiner* — Suzanne Barrett
(74) *Attorney, Agent, or Firm* — Joseph S. Heino; Patrick M. Bergin

(57) ABSTRACT

A compact power lock is provided for use in a pickup truck tailgate with a key lockable latch that relies on a lock lever for its operation. The power lock includes a linear power actuator attached to a sliding actuating link with two tabs that engage the lock lever of the key lockable tailgate latch. The actuating link is arranged alongside the linear power actuator so as not to add to its length and to attain maximum compactness. The spacing of the two tabs is such that the lock lever can move freely between the locked and unlocked position when it is activated by the key lockable tailgate latch. When the actuator is energized by voltage pulses of alternating polarity its motion is transferred to the attached actuating link and the tabs push the locking lever to or fro to lock or unlock the tail gate.

10 Claims, 6 Drawing Sheets

COMPACT POWER LOCK

RELATED APPLICATIONS

The present invention application claims the benefit of U.S. Provisional Application No. 61/092,303 filed on Aug. 27, 2008. The entire teachings of the above application are incorporated herein by reference,

FIELD OF INVENTION

The present invention relates to an automotive door lock that can be actuated both manually with a key and remotely, by an electrically powered actuator. More specifically, it applies to a lock for the tailgate of a pickup truck that has been designed for manual operation that needs to be upgraded subsequently for power operation after the truck has been purchased, also known as an aftermarket installation.

BACKGROUND OF INVENTION

Car and truck manufacturers have offered the option of electrically operated door locks for a number of years. This option has enjoyed widespread popularity for two reasons: 1, with the push of one button the operator can lock and unlock all door locks simultaneously and 2, the system lends itself to remote operation so that the operator can lock and unlock all doors from outside of the vehicle with a radio signal. This feature however has never been offered for the lock of the tailgate of pick-up trucks. As a result of the paucity of factory installed power tailgate locks, there have been a number of aftermarket manufacturers who have tried to adapt electrically operated mechanisms to lock and unlock the tailgate.

Tailgate construction consists typically of a box structure that extends the width of the truck and is hinged horizontally along the bottom edge to provide access to the cargo area when folded down. A horizontal stiffening strut ties the front and rear faces of the tailgate to prevent flexing of the two faces. The tailgate is secured in the closed position by two catches on the sides of the tailgate. The catches are released by two control rods leading to a centrally mounted latch assembly. The control rods and the latch assembly are mounted in the horizontal cavity that extends the whole length of the tailgate defined by the stiffening strut and the sides This cavity presents little limitation to the width of any power lock that is intended to be mounted alongside an existing latch assembly. As a result, prior art power locks, as shown in U.S. Pat. No. 5,174,619 and U.S. Pat. No. 5,295,374 have been constructed with the linear actuator and the associated control linkages positioned horizontally.

However new truck designs, as described in U.S. Pat. No. 6,918,624 may include a fold-out step stored inside the tailgate which severely limits the space available for a lock installation. The fold out step retracts into two vertical channels positioned in close proximity to the latch assembly and interfere with the installation of a power lock as described in the prior art. This restriction in a lateral direction is compounded by the restriction imposed vertically by the already existing stiffening strut.

A need exist, therefore, for a very compact power lock that can be installed in a tailgate with the space limitation resulting from the presence of a fold out step.

SUMMARY OF THE INVENTION

The present invention comprises an electrically powered linear actuator that is mounted onto a key lockable latch assembly at a right angle to the hinge axis of the tailgate with a sliding actuating link attached to the output link of the actuator specially formed to move back alongside the actuator to reset the position of said latch assembly to and from a locked to an unlocked position by two transverse tabs in response to electrical inputs of opposing polarity. In this manner the actuator can be stacked up over the existing key lock, resulting in a very compact installation. Said actuating link may further be spring loaded to return to a central position when the actuator is not energized and the tabs may be situated such as to provide sufficient lost motion in this position for the latch assembly to function freely when actuated by the key alone.

The primary advantage of the present invention is the provision of a power lock that can be installed in tailgates with only a limited amount of space.

Another advantage of the present invention is the provision of a power lock of a simple construction relying on a single moving component to actuate the locking mechanism.

Another advantage of the present invention is the provision of a power lock that can be easily installed.

Another objective of the present invention is the provision of an aftermarket power lock that can operate in tandem with a factory installed manual lock in such a fashion that one lock does not block the operation of the other.

These and other advantages will become apparent from the following description of the invention.

DESCRIPTION OF THE INVENTION

Figure 1:
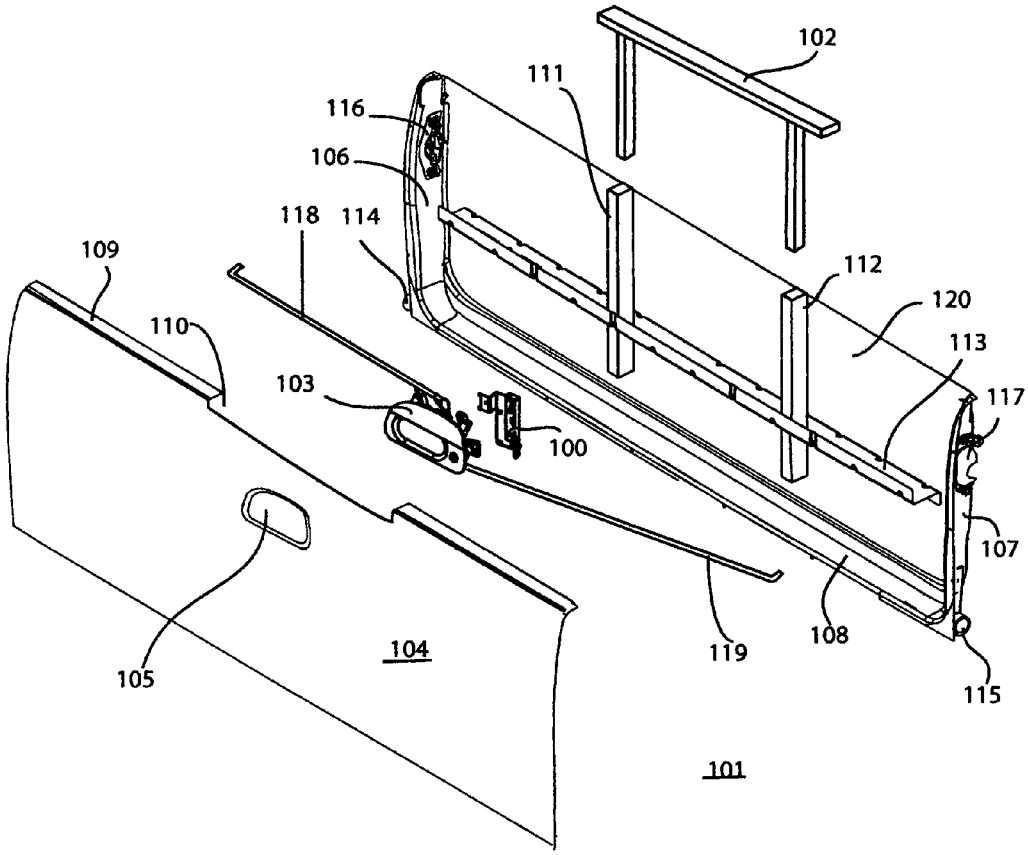
FIG. 1 is a perspective exploded view of a tailgate with an integral fold-out step with a key lockable latch assembly and one embodiment of the power lock of the present invention.

Referring to FIG. 1 a compact power lock 100 is illustrated installed in a tailgate 101 with a fold out step 102 and a lockable latch assembly 103. The tailgate 100 is constructed in the conventional manner as a box structure comprising front panel 104, with an aperture 105 for the lockable latch assembly 103, rear panel 120, side panels 106 and 107, bottom panel 108, and top panel 109 with an aperture 110 for the fold out step 102. Fold out step 102 slides in and out of cross rails 111 and 112. A stiffening panel 113 is located in the interior of the tailgate 101. The tailgate 101 hinges on cups 114 and 115 and is locked in the closed position by latches 116 and 117 which are released by control rods 118 and 119 connected to the lockable latch assembly 103.

Figure 2:
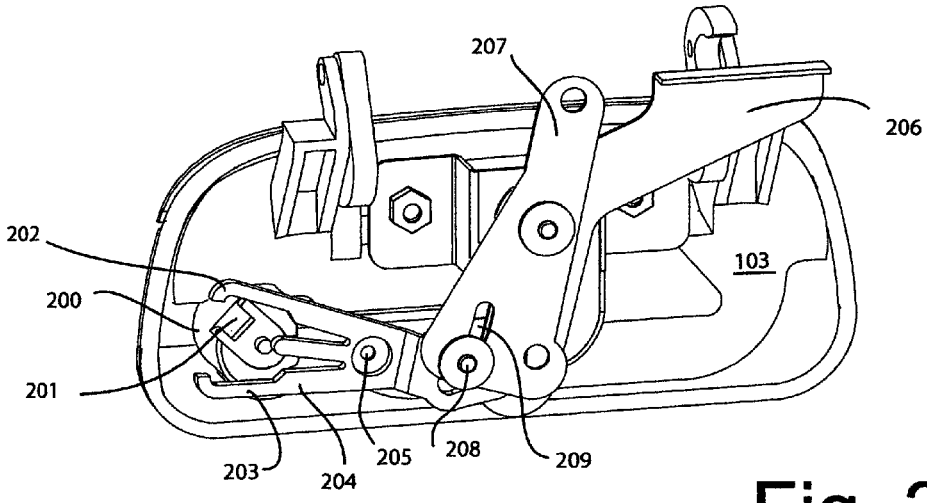
FIG. 2 is a perspective view of a conventional key lockable latch assembly.

The construction of the lockable latch assembly 103 is well known in the art such as shown in U.S. Pat. No. 6,523,869. It is reviewed here briefly because the present invention operates with it in tandem. Referring to FIG. 2 the lockable latch assembly 103 is shown to have a tumble lock 200 with an attached locking pawl 201. Locking pawl 201 engages the fingers 202 and 203 of the lock lever 204 that pivots on pivot pin 205. The locking pawl 201 lies in a neutral position centered between fingers 202 and 203 when at rest An over center spring (not shown) biases the lock lever 204 into one of two positions, up or down. In the up position it couples the drive lever 206 to the latch lever 207 with pin 208 sliding in slot 209 to activate said latch lever 207 with the drive lever 206 and thus unlock the latch assembly 103. In the down position it uncouples the latch lever 207 from the drive lever 206 thus locking the latch assembly 103. The operation of this commonly used lockable latch assembly 103 is presented in greater detail in the above mentioned reference but the salient feature for the understanding of the present invention is that the position of the lock lever 204 determines whether it is locked or unlocked.

Figure 3:
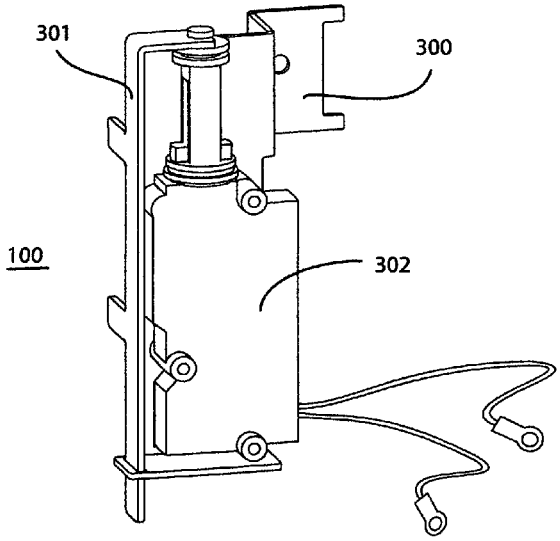
FIG. 3 is a perspective view of one embodiment of the power lock of the present invention before installation.

The components of a compact power lock 100 constructed according to the present invention are shown in FIG. 3. They consist principally of the power lock bracket 300, the actuating link 301 and the linear power actuator 302.

Figure 4:
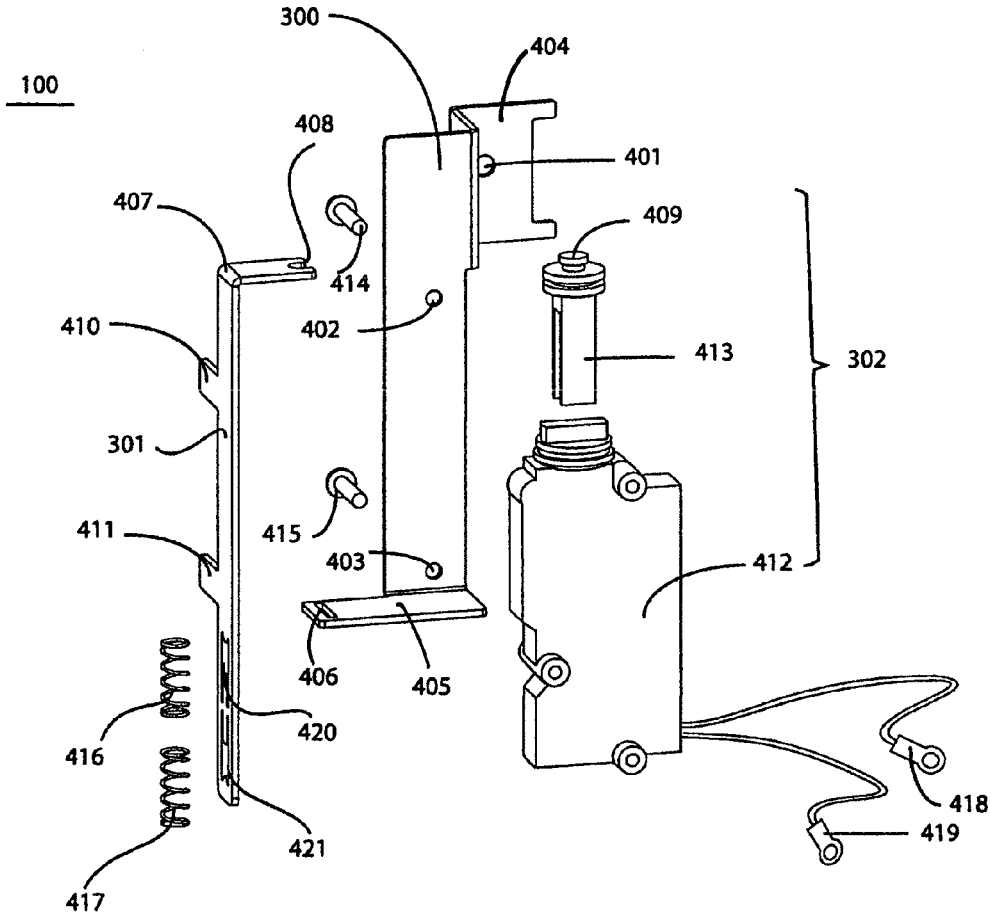
FIG. 4 is an exploded perspective view of that embodiment to illustrate its various components.

These components are shown in greater detail in FIG. 4. The bracket 300 contains a mounting hole 401, one or more actuator mounting holes 402 and 403, a flange 404 to position the unit in relation to the lockable latch assembly 103, a flange 405 with a slot 406 to receive and to guide the actuating link 301 as it slides to and fro.

The actuating link 301 has an attachment flange 407 with an attachment slot 408 that couples it to the actuator bolt button 409. Attachment flange 407 is bent in a reverse direction so that the free end of the actuating link 301 points towards the stationary end of the linear power actuator 302 The actuating link 301 also has two tabs 410 and 411 whose function is to transmit the motion of the linear power actuator 302 to the lockable latch assembly 103

The linear power actuator 302 is of a conventional construction comprising a body 412 and a sliding actuator bolt 413 that terminates in attachment button 409 or some other suitable means of fastening. The body 412 may be mounted to the power lock bracket 300 with screws 414 and 415. Optional springs 416 and 417, mounted into apertures 420 and 421 may center the actuating link 301 in the neutral position when the actuator 302 is de-energized. An electrical impulse applied to leads 418 and 419 propels the actuating link 301 momentarily outward and an electrical impulse of a reversed polarity pulls it momentarily inward.

The geometry of the actuating link 301 is of special significance. By virtue of the reverse bend of the attachment flange 407 and the placement of the guiding slot 406 at the stationary end of the linear power actuator 302, the two tabs 410 and 411 are positioned alongside the body 412 and thus the compact power lock 100 can be stacked up in close proximity to the lock lever 204 of the lockable latch assembly 103 to achieve the desired level of compactness.

Figure 5A:
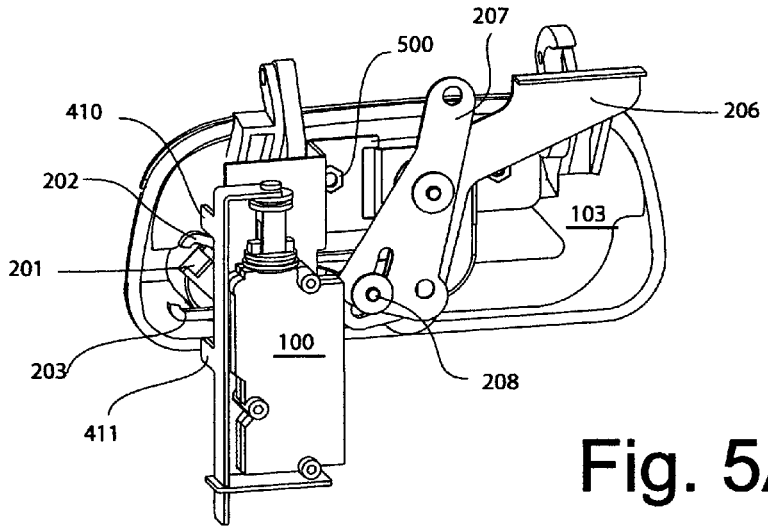
FIGS. 5A and 5B are a perspective view of the installation of the present invention in the locked and unlocked positions as actuated solely by the manual lock.
Figure 6A:
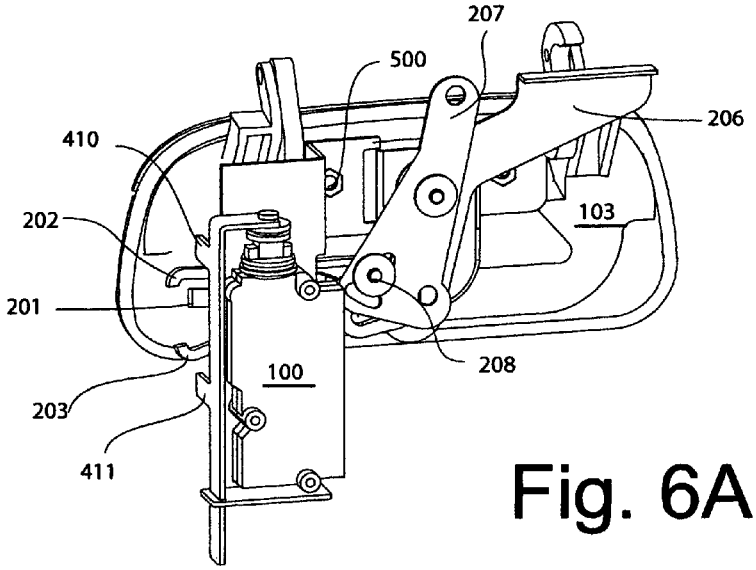
FIGS. 6A and 6B are a perspective view of the installation of the present invention in the locked and unlocked positions as actuated solely by the power lock.

The installation of the compact power lock 100 onto lockable latch assembly 103 is illustrated in FIGS. 5A and B and FIGS. 6A and B. The compact power lock 100 mounts onto the lockable latch assembly 103 with one of the existing fasteners 500 in such a position that the two tabs 410 and 411 straddle the fingers 202 and 203 of the lock lever 204.

Figure 5B:
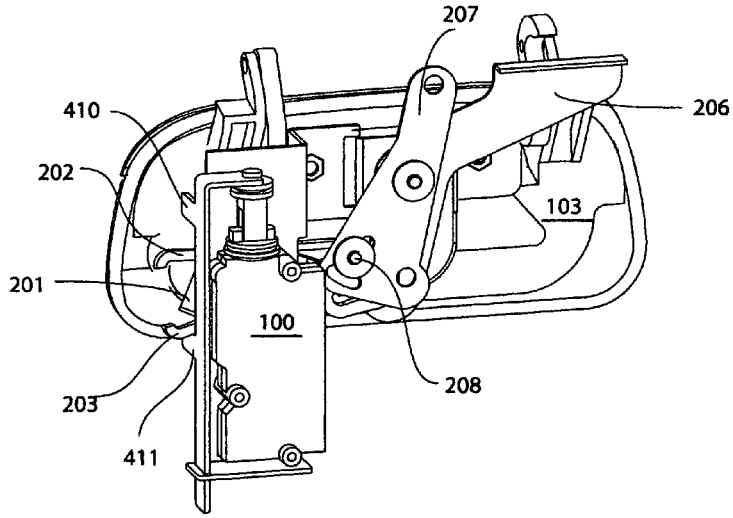

As shown in FIGS. 5A and 5B, the spacing between the two tabs 410 and 411 is also significant. It is desirable to space them wide enough apart to permit the fingers 202 and 203 of the lock lever 204 (hidden in this view) to shuttle freely between the locked and unlocked position when driven by the locking pawl 201 without incurring the drag of moving the sliding actuator bolt 412. This situation is illustrated in FIGS. 5A and 5B which shows how the lockable latch assembly 103 can be locked and unlocked by the tumble lock 200 unimpeded the compact power lock 100.

Figure 6B:
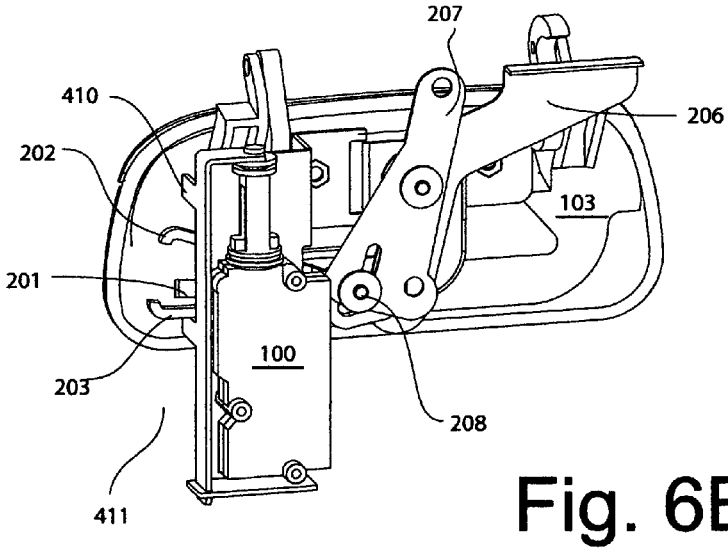

Conversely, FIGS. 6A and 6B show how the lockable latch assembly 103 is locked and unlocked by the compact power lock 100 unimpeded the tumble lock 200.

Figure 7:
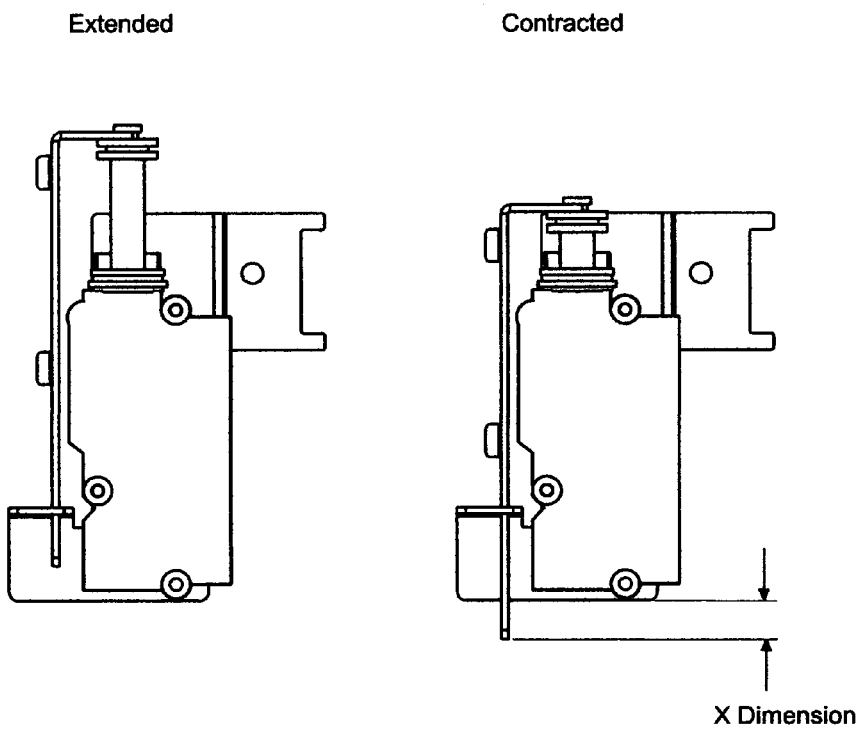
FIG. 7 is a comparison of the footprint of the present invention and the footprint of the actuator alone in the "locked" and "unlocked" positions

Referring to FIG. 7 a comparison of the footprint of the present invention is made. It can be seen that the present invention is so compact, that its footprint practically matches that of the actuator alone in the vertical direction, exceeding it by the small dimension X.

While this invention has been particularly shown and described with references to example embodiments thereof, it will be understood by those skilled in the art that various changes in form and details may be made therein without departing from the scope of the invention encompassed in the appended claim.

The invention claimed is:

1. A tail gate lock comprising:

(a) a key lockable latch assembly with a pivoting lock lever;

(b) an electrically powered reciprocal linear actuator comprising a stationary part and a movable part; and (c) a sliding actuating link comprising a first end being attached to the movable part of the electrically powered reciprocal linear actuator, the link also being supported near the stationary part of the actuator, the sliding actuating link further comprising two tabs transverse to the sliding direction arranged to convert a linear motion of the linear actuator into rotation of the lock lever.

2. The tail gate lock of claim 1, wherein the electrically powered reciprocal linear actuator is mounted at a substantially right angle to a hinge axis of the tail gate.

3. The tail gate lock of claim 1, wherein the tabs of the sliding actuating link are long enough to engage the pivoting lock lever when the electrically powered reciprocal linear actuator is stacked on top of the key lockable latch assembly.

4. The tail gate lock of claim 1, wherein the electrically powered reciprocal linear actuator has a "locked" position and an "unlocked position" and wherein the tail gate lock has a length wherein the electrically powered reciprocal linear actuator fits within the length of the tailgate lock in the vertical direction in both the "locked" and "unlocked" positions.

5. The tail gate lock of claim 1, wherein the sliding actuating link is spring loaded to return to a neutral position when the electrically powered reciprocal linear actuator is de-energized.

6. A compact power lock for use with a tail gate lock comprising a lockable latch assembly and a lock lever having a first finger and second finger, the compact power lock comprising:

a power lock bracket attachable to the tailgate lock;

a linear power actuator attached to the power lock bracket, and an actuating link connected at a first portion to the linear power actuator and being supported at a second portion by the power lock bracket, the actuating link further comprising a first tab and a second tab, the linear power actuator being operable to move the actuating link.

7. The compact power lock of claim 6 wherein the linear power actuator is operable to move the actuating link between a first extended position and a second retracted position.

8. The compact power lock of claim 7 wherein the actuating link is spring biased into a neutral position.

9. The compact power lock of claim 8 wherein the lockable latch assembly is operable without interference when the actuating link is in the neutral position.

10. The compact power lock of claim 6 wherein upward actuation of the linear actuator moves the first tab into contact with a first finger to lock the lockable latch assembly and downward actuation of the linear actuator moves the second tab into contact with a second finger to unlock the lockable latch assembly.

* * * * *